United States Patent [19]

Grigorenko et al.

[11] 4,064,733

[45] Dec. 27, 1977

[54] PRESS

[76] Inventors: Anatoly Sergeevich Grigorenko, ulitsa Tovstukho, 9, kv. 21; Vasily Savelievich Kravchenko, ulitsa Industrialnaya, 22, kv. 1; Jury Antonovich Moroz, ulitsa Fugenfirova, 11, kv. 91; Leonid Ivanovich Kortusov, prospekt Mira, 57-a, kv. 10; Vladimir Ivanovich Vimba, ulitsa 50 let komsomola, 4-v, kv. 55, all of Omsk, U.S.S.R.

[21] Appl. No.: 729,874

[22] Filed: Oct. 5, 1976

[51] Int. Cl.[2] ..... B21J 9/12

[52] U.S. Cl. ..... 72/453.03; 72/456; 100/289

[58] Field of Search ..... 72/453.03, 453.11, 454, 72/455, 456; 100/289

[56] References Cited

U.S. PATENT DOCUMENTS

| | | | |
|---|---|---|---|
| 1,760,432 | 5/1930 | Murray | 72/454 |
| 3,035,514 | 5/1962 | Harvanek | 100/289 |
| 3,111,895 | 11/1963 | Kraft et al. | 72/456 |
| 3,668,921 | 6/1972 | Budman et al. | 72/456 |
| 3,881,343 | 5/1975 | Ducate | 72/455 |

*Primary Examiner*—Michael J. Keenan
*Attorney, Agent, or Firm*—Fleit & Jacobson

[57] ABSTRACT

A press comprises a plunger mounted for reciprocations, one die rigidly fixed to the frame and the other die secured to a slide mounted for reciprocations in the frame guides for closing and opening the dies. The press is provided with a mechanism for clamping the dies during stamping which comprises a nut-screw kinematic couple. One member of the couple is rigidly connected to the slide and the other member, which performs the rotary motion, supports two adjoining discs, one disc being rigidly connected to said member and the other disc being connected to said member by means of a self-locking thread for helical movement relative to the first disc under the action of inertia forces for clamping the dies during stamping, and there is provided a drive for returning the second disc to the initial position.

The disclosed press, according to the invention, has an improved efficiency with reduced power consumption as compared to prior art presses.

2 Claims, 3 Drawing Figures

PRESS

The invention relates to metal forming and, more specifically, to presses.

The press, according to the invention, may be most advantageously used for closed-die stamping of crown gear blanks, tees, crosses, bushings and other parts of intricate shape which require the use of splitting dies.

Known in the art are presses comprising a frame having a table supporting one die.

The other die is secured to a slide which is mounted in the frame guides and connected to piston rods of actuating cylinders performing reciprocations of the slide for closing and opening the dies.

A plunger is secured to another slide which is mounted in other guides of the frame for reciprocations.

The dies of the above-described press are clamped during stamping by means of the actuating cylinders which are used to reciprocate the slide carrying the die.

In order to ensure reliable clamping of the dies during stamping and to prevent the formation of fins in the splitting plane, the clamping force should be developed at a level which may approach the value of the deformation force. For that purpose, actuating cylinders of comparatively large size are used.

At the same time, it is necessary to obtain an adequate speed of movement of the slide carrying the die in order to prevent the hot blank from cooling and to obtain the design throughput capacity of the press.

Fulfillment of both conditions (that is comparatively great force and adequate speed) requires a considerable increase in the power consumption and finally results in lower efficiency of the press.

It is an object of the invention to provide a press having a device for clamping the dies during stamping.

Another object of the invention is to reduce power consumption.

Still another object of the invention is to improve the efficiency of the press.

With these and other obejcts in view, the invention contemplates a press, wherein a plunger is mounted for reciprocations, one die is rigidly fixed to the frame and the other is rigidly secured to a slide mounted in the frame guides for reciprocations for closing and opening the dies, and wherein, according to the invention, the press is provided with a mechanism for clamping the dies during stamping comprising a nut-screw kinematic couple having one member rigidly connected to the slide and the other member, which performs the rotary motion, supporting two discs adjoining each other, one disc being rigidly connected to said member and the other disc being connected to said member by means of a self-locking thread for helical meovment relative to the first disc under the action of inertia forces for clamping the dies during stamping, and there is provided a drive for returning the second disc to the initial position.

The drive for returning the second disc to the initial position preferably comprises a ratchet-and-pawl mechanism in which the ratchet wheel is the second disc provided with a ratchet rim on the outer cylindrical surface for that purpose, and the pawl is supported on a carriage mounted in the frame guides for reciprocations in the direction normal to the geometrical axis of the nut-screw couple and is elastically urged towards the disc.

The above-described construction of the drive for returning the second disc to the initial position is structurally simple, facilitates the manufacture and is reliable in operation.

The press, according to the invention, provides for reliable clamping of the dies during stamping in closed dies, thus eliminating the formation of fins and improving the accuracy of stamping.

Furthermore, in the press, according to the invention, the construction of the mechanism for clamping the dies ensures rapid clamping under the action of inertia forces developed upon stoppage of the slide at the moment of closing of the dies.

This facility enables employment of the press for hot stamping, where high speeds of working members of the press are required.

The disclosed press features power consumption which is considerably lower than that of the prior art presses, and its efficiency is substantially greater.

The invention will now be described with reference to a specific embodiment illustrated in the accompanying drawings, in which.

Figure 1:
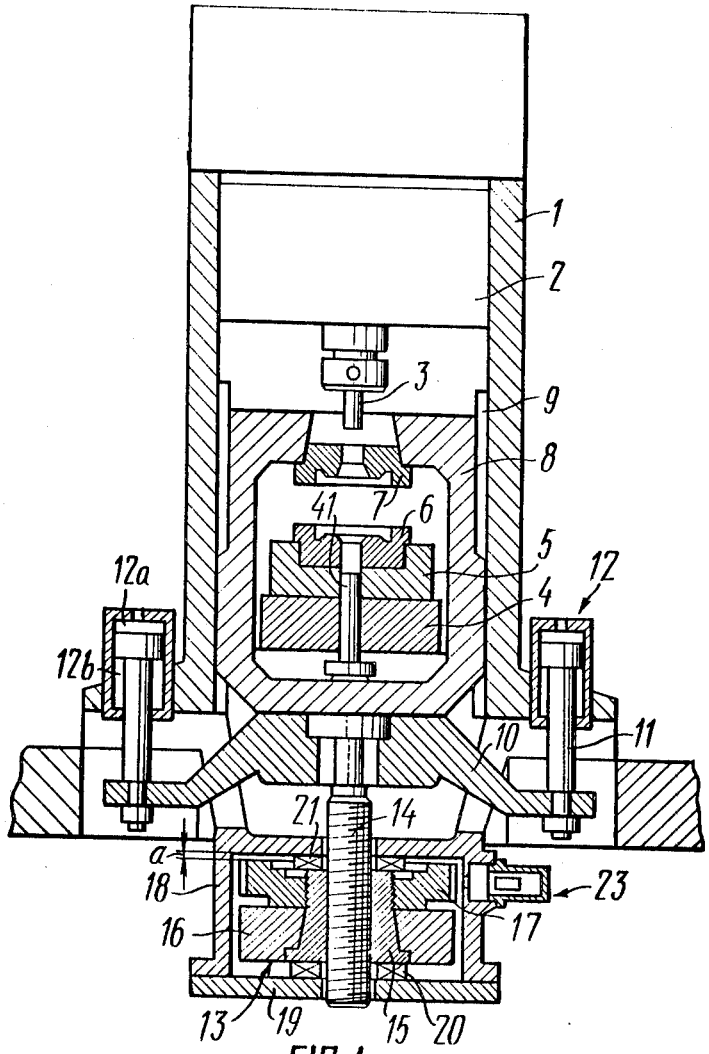
FIG. 1 shows a longitudinal cut-off view of a press, according to the invention, with discs of the mechanism for clamping the dies in the initial position.

The press comprises a frame 1 (FIG. 1) having guides mounting a slide 2 carrying a plunger 3, The slide 2 is mounted for reciprocations to provide for work and return strokes of the plunger 3.

The frame 1 has a table 4 accommodating a die plate 5 supporting a die 6 secured thereto.

Another die 7 is secured to a slide 8 which is mounted in guides 9 of the frame 1.

The slide 8 is rigidly connected to a cross-piece 10 which is connected to piston rods 11 of actuating cylinders 12 mounted on the frame 1.

The actuating cylinders 12 are used as a drive for displacing the slide 8 for closing and opening the dies 6 and 7.

In order to keep the dies 6 and 7 in the closed position during stamping, there is provided a mechanism 13 for clamping the dies 6 and 7.

this mechanism comprises a nut-screw kinematic couple. A screw 14 of this couple is a member performing reciprocations and for that purpose it is connected to the slide 8.

The member performing the rotary motion is a nut 15. Two discs 16 and 17 are mounted on the nut 15 one above the other. The disc 16 is rigidly fixed to the nut 15 and is used as a flywheel for storing the kinetic energy. The disc 17 is mounted above the disc 16 and connected to the nut 15 by means of a self-locking thread (that is, by means of a thread having the angle of thread smaller than the angle of friction).

The direction of this thread is the same as that of the screw 14.

The machanism 13 is accommodated in a casing 18 closed by a cover 19.

The casing 18 is rigidly connected to the frame 1 and has bearings 20 and 21 for journalling the nut 15.

The disc 16 is connected to the nut 15 by means of a member 22 (FIG. 2) which is conventionally not shown in FIG. 1.

In the initial position, the discs 16, 17 adjoin each other as shown in FIG. 1.

A gap "*a*" is provided between the disc 17 and the casing 18 to define the amount of axial stroke of the disc 17.

Figure 3:
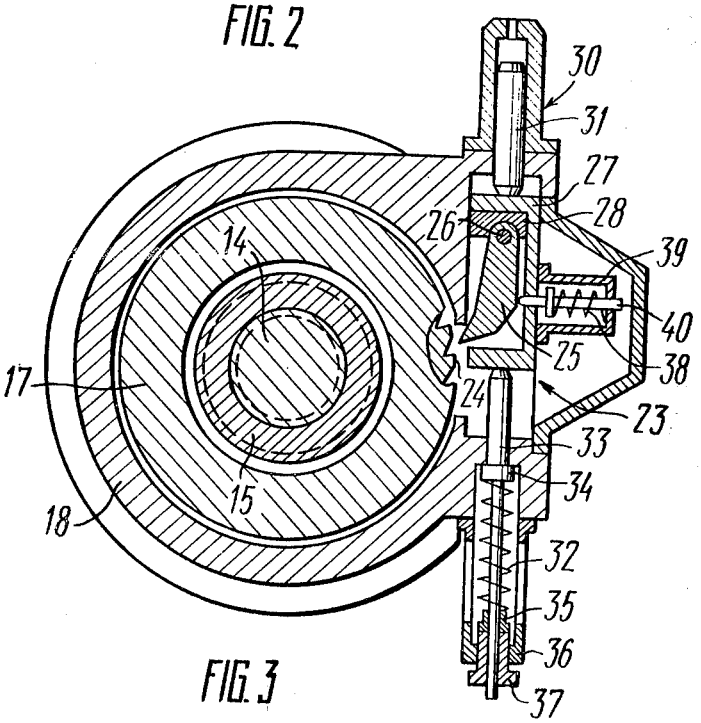
FIG. 3 is a sectional view taken along line III—III of FIG. 2.

A drive 23 (FIG. 3) is provided for returning the disc 17 to the initial position.

The drive comprises a ratchet-and-pawl mechanism in which the ratchet wheel is the disc 17 having ratchet teeth 24 provided for that purpose on the outer cylindrical surface thereof.

A pawl 25 cooperating with the teeth 24 fo the disc 17 is supported on a pin 26 fixed to a carriage 27.

The carriage 27 has a member 28 taking-up forces developed upon engagement of the pawl 25 with the teeth 24 of the disc 17.

The carriage 27 is mounted in guides 29 (FIG. 2) of the casing 18 which extend to the direction normal to the geometrical axis of the screw 14.

The carriage 27 is displaced by means of an actuating cylinder 30 (FIG. 3) having a piston rod 31 acting on one side of the carriage 27.

The carriage 27 is returned to the initial position by means of a spring 32 fitted on a rod 33 and acting on the carriage 27 on the opposite side thereof.

One end of the spring 32 bears against a collar 34 of the rod 33, and the other end of the spring bears against a bushing 35 mounted in a sleeve 36 connected to the casing 18. A nut 37 threaded into the bottom wall of the sleeve 36 is used for adjusting the force of the spring 32.

The pawl 25 is constantly elastically urged towards the disc 17 in the direction normal to the direction of movement of the carriage 27 by means of a spring 38 which is accomodated in a sleeve 39 and acts on the pawl through a rod 40. An ejector 41 (FIG. 1) used for ejecting a stamped blank is secured to the slide 8 to extend along the stamping axis.

The above-described press functions in the following manner.

A heated starting blank is placed in the cavity of a fixed die 6.

Then the piston chambers 12*a* of the cylinders 12 are connected to a supply source (not shown), and the piston rod chambers 12*b* are connected to a discharge line.

A force is thus transmitted from the cylinders 12, via the piston rods 11, to the slide 8 causing it to move in the guides 9 of the frame 1.

The die 7, as well as the screw 14 of the mechanism 13 for clamping the dies 6 and 7 connected to the slide are lowered together with the slide 8.

Linear motion of the screw 14 results in the rotary motion of the nut 15 which is connected to the screw by means of a self-locking thread.

Two discs 16 and 17 rotate in unison, together with the nut 15.

At the end of the stroke of the slide 8, the die 7 closes with the die 6 to form a closed die, and a certain deformation of the starting blank can occur, if the height of the blank is greater than the die impression.

Upon closing of the dies 6 and 7, the linear motion of the slide 8 and screw 14 is discontinued, and the rotation of the nut 15 and disc 16 connected thereto is also stopped.

The kinetic energy accumulated in the disc 16 is consumed for creating a tensile force in the screw 14 which is transmitted through the slide 8 to ensure the clamping of the dies 6 and 7.

At the same time, upon stoppage of the nut 15 and the disc 16, the disc 17 performs a helical motion relative to the nut 15 under the action of inertia forces.

Figure 2:
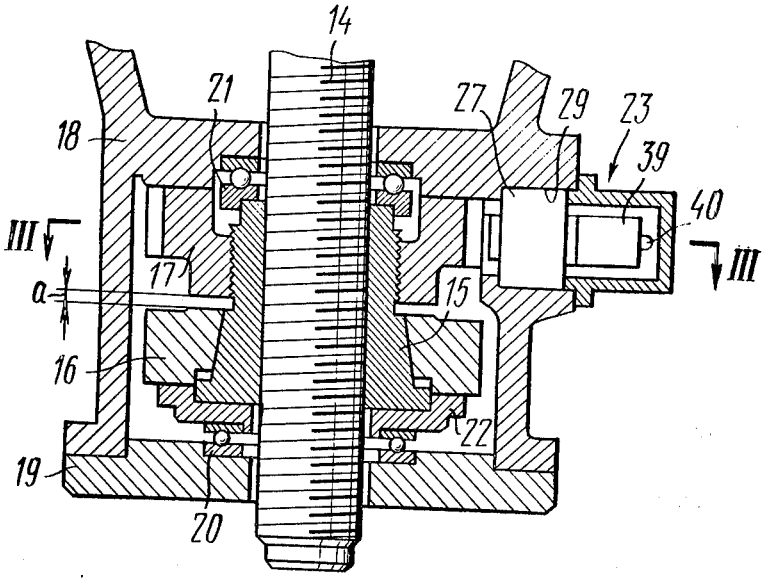
FIG. 2 shows the mechanism for clamping the dies with the discs in the position corresponding to the clamping of the dies during stamping.

Thus, the disc 17 moves away from the disc 16 and, after taking-up the gap "*a*," abuts with the upper end face against the casing 18 as shown in FIG. 2.

Since the disc 17 has a self-locking thread, it is sort of wedged between the nut 15 and the casing 18. Therefore, the clamping force developed by the disc 16 is fixed, and the dies 6 and 7 remain clamped during stamping.

Then the slide 2 carrying the plunger 3 is actuated. At the end of the work stroke, the plunger 3 enters an opening of the die 7 to deform the blank within the closed die.

Upon completing the work stroke, the slide 2 is returned to the initial positiion together with the plunger 3.

After the stamping operation is over, the clamping mechanism 13 should be returned to the initial position. For that purpose, the chamber of the cylinder 30 is connected to a supply source. Under liquid pressure, the piston rod 31 moves the carriage 27 in the guides 29.

The rod 33 is displaced to compress the spring 32.

The pawl 25 moves together with the carriage 27 and engages, under the action of the spring 38, one of the teeth 24 of the disc 17 to rotate the disc 17 at a certain angle.

The disc 17 is moved away from the casing 18 and returns to the initial position (FIG. 1).

Thus, the wedging action of the disc 17 is discontinued, and the axial force which acted along the screw 14 to provide for clamping of the dies 6, 7 is removed.

Immediately after rotation of the disc 17, the carriage 27 is returned to the initial position, and for that purpose the chamber of the cylinder 30 is connected to a discharge line.

The spring 32 bearing against the collar 34 of the rod 33 imparts the motion to the carriage 27 until it is stopped in the initial position.

Then the piston rod chambers 12*b* of the cylinders 12 are connected to a supply source, and the piston chambers 12*a* are connected to a discharge line.

The slide 8 is displaced upwards in the guides 9. The die is open because the die 7 is lifted with the slide 8.

At the end of the stroke, the stamped forging is ejected by the ejector 41, if the forging remains rested on the lower die 6.

If the forging remains in the die 7, it is ejected by the plunger 3.

What is claimed is:

1. A press comprising: a frame; a plunger mounted on said frame for reciprocations; a stamping die comprising two dies; one die of said stamping die secured to said frame; an slide mounted in guides of said frame; the other die of said stamping die secured to said slide; said slide being reciprocably mounted for closing and opening said dies; means for clamping said dies during stamping comprising a nut-screw kinematic couple; one member of said kinematic couple adapted to perform linear motion, being connected to said slide; the other member of said kinematic couple adapted to perform rotary motiion; first and second discs mounted on said other member and adjoining each other in a first postion; said first disc fixedly connected to said other member; said second disc connected to said other member by a self-locking thread means for helical motion of said second disc relative to said first disc under the action of inertia forces following the closing of said dies for clamping the dies during stamping; a drive means for returning said second disc to said first position following stamping; and means for displacing said plunger and said slide.

2. A press according to claim 1, wherein the drive means for returning the second disc to said first position comprises a ratchet wheel-and-pawl means in which the ratchet wheel comprises the second disc with a ratchet rim on the outer peripheral surface thereof, and the pawl is supported on a carriage mounted in the frame guides for reciprocations in the direction normal to the geometrical axis of the nut-screw kinematic couple and means for urging said carriage towards the second disc.

* * * * *